US009045858B2

(12) United States Patent
Gomi et al.

(10) Patent No.: US 9,045,858 B2
(45) **Date of Patent: *Jun. 2, 2015**

(54) SHEET MANUFACTURING APPARATUS

(71) Applicant: SEIKO EPSON CORPORATION, Tokyo (JP)

(72) Inventors: Katsuhito Gomi, Nagano (JP); Shunichi Seki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/224,399

(22) Filed: Mar. 25, 2014

(65) Prior Publication Data

US 2014/0290888 A1 Oct. 2, 2014

(30) Foreign Application Priority Data

Mar. 27, 2013 (JP) ..... 2013-065808
Feb. 13, 2014 (JP) ..... 2014-025123

(51) Int. Cl.
*D21F 1/00* (2006.01)
*D21D 5/24* (2006.01)

(52) U.S. Cl.
CPC ..... *D21D 5/24* (2013.01); *B08B 2215/006* (2013.01)

(58) Field of Classification Search
USPC ..... 162/254, 261, 4
See application file for complete search history.

(56) References Cited

U.S. PATENT DOCUMENTS

| | | | | |
|---|---|---|---|---|
| 3,741,863 | A | 6/1973 | Hunter et al. | |
| 4,079,837 | A | 3/1978 | Grube et al. | |
| 4,176,054 | A | 11/1979 | Kelley | |
| 6,260,777 | B1 | 7/2001 | Seppanen | |
| 6,306,248 | B1 | 10/2001 | Eley | |
| 2014/0027075 | A1 * | 1/2014 | Yamagami et al. | 162/4 |

FOREIGN PATENT DOCUMENTS

| | | | |
|---|---|---|---|
| EP | 2664708 | A1 | 11/2013 |
| JP | 2012-144819 | A | 8/2012 |
| JP | 2012-144825 | A | 8/2012 |

* cited by examiner

*Primary Examiner* — Mark Halpern
(74) *Attorney, Agent, or Firm* — Global IP Counselors, LLP

(57) ABSTRACT

A sheet manufacturing apparatus includes a measuring unit configured to measure thickness and air permeability of a defibration object containing fibers, a defibrating unit configured to dry-defibrate the defibration object, and a classifying unit configured to separate and remove, by airflow classification, foreign substances other than the fibers from the defibrated material defibrated at the defibrating unit.

5 Claims, 10 Drawing Sheets

| INLET | TYPE | COLLECTION RATE [%] | |
|---|---|---|---|
| | | IN CASE OF FOREIGN SUBSTANCE CONTENT RATE IN DEFIBRATED PIECES 35 [wt%] | IN CASE OF FOREIGN SUBSTANCE CONTENT RATE IN DEFIBRATED PIECES 10 [wt%] |
| 41 | DEFIBRATED FIBERS | 95 | 91 |
| | FOREIGN SUBSTANCES | 80 | 91 |
| 41' | DEFIBRATED FIBERS | 91 | 87 |
| | FOREIGN SUBSTANCES | 92 | 99 |

| OPENING RATE OF BUTTERFLY DAMPER [%] | TYPE | COLLECTION RATE [%] | |
|---|---|---|---|
| | | IN CASE OF FOREIGN SUBSTANCE CONTENT RATE IN DEFIBRATED PIECES 42 [wt%] | IN CASE OF FOREIGN SUBSTANCE CONTENT RATE IN DEFIBRATED PIECES 15 [wt%] |
| 50 (HALF OPEN) | DEFIBRATED FIBERS | 97 | 92 |
| | FOREIGN SUBSTANCES | 82 | 91 |
| 100 (FULL OPEN) | DEFIBRATED FIBERS | 93 | 87 |
| | FOREIGN SUBSTANCES | 90 | 95 |

SHEET MANUFACTURING APPARATUS

CROSS-REFERENCE TO RELATED APPLICATIONS

This application claims priority to Japanese Patent Application No. 2013-065808 filed on Mar. 27, 2013 and Japanese Patent Application No. 2014-025123 filed on Feb. 13, 2014. The entire disclosure of Japanese Patent Application Nos. 2013-065808 and 2014-025123 is hereby incorporated herein by reference.

BACKGROUND

1. Technical Field

The present invention related to a sheet manufacturing apparatus.

2. Related Art

In used paper discharged from offices, used paper describing confidential matters is included. Therefore, also from the viewpoint of security protection, it is desired that such used paper can be processed in their offices. In small offices, a wet-type sheet manufacturing apparatus, which uses a large amount of water, cannot be suitably used, and therefore a dry-type sheet manufacturing apparatus simplified in structure and minimized in water usage has been proposed (see, for example, Japanese Unexamined Laid-open Patent Application Publication No. 2012-144819).

In such a sheet manufacturing apparatus, when defibrating used paper, the paper is separated into fibers and foreign substances (e.g., tonner or additive agent) other than fibers. Thereafter, at a classifying portion, a deinking process for removing foreign substances is performed. Then, using the defibrated fibers in which foreign substances were removed, a sheet is produced. There, however, arises a problem that even if performing a deinking process in the same manner, when a sheet is formed, spots, etc., by foreign substances will be generated, deteriorating the quality of the sheet. There also exists a problem that although spots, etc., by foreign substances will not be generated, the sheet thickness becomes insufficient. The problems will occur not only in cases where used paper is used as a stock material but also in cases where a pulp sheet is used as a stock material.

With respect to this, the inventors of this application have reached the conclusion that the cause is due to the difference of contents of foreign substances contained in a stock material. If the content of foreign substances in a stock material is large, the deinking process becomes insufficient, which results in a mixture of foreign substances in the collected (classified) defibrated fibers. Further, if the content of foreign substances in a stock material is small, defibrated fibers will be removed together with foreign substances by a deinking process, deteriorating the collection rate of defibrated fibers, which in turn results in an insufficient thickness when forming into a sheet. However, no device for easily measuring the content of foreign substances contained in a stock material has been available. Further, there was no disclosure on how to control depending on the content of foreign substances.

SUMMARY

A sheet manufacturing apparatus according to this applied example includes a measuring unit configured to measure thickness and air permeability of a defibration object containing fibers, a defibrating unit configured to dry-defibrate the defibration object, and a classifying unit configured to separate and remove, by airflow classification, foreign substances other than the fibers from the defibrated material defibrated by the defibrating unit.

With this structure, a defibrating unit for dry-defibrating the defibration object containing fibers as a stock material, and a classifying unit for separating and removing foreign substances other than the fibers from the defibrated material are provided. With respect to the defibration object in a state before being defibrated, the thickness and the air permeability are measured. With this measurement, for example, it becomes possible to presume the content rate of foreign substances contained in the defibration object. By this, for example, it becomes possible to perform the apparatus adjustment based on the content rate of the foreign substances contained in the defibration object, which enables to efficiently remove foreign substances and maintain the collection rate of defibrated fibers. As a result, the production efficiency can be improved and further a high-quality sheet can be produced. The phrase of "separate and remove foreign substances" is not intend to limit to removal of all of foreign substances, and includes a case in which foreign substances is partially removed.

In the sheet manufacturing apparatus according to the aforementioned applied example, a flow velocity of the defibrated material passing through the classifying unit is controlled depending on a measured result of the measuring unit.

With this structure, by controlling the flow velocity of defibrated material in the classifying unit depending on the content rate of foreign substances from the measured result by the measuring unit, the balance between the efficiency of removing foreign substances and the collection rate of defibrated fibers can be secured. With this, it is possible to produce a high-quality sheet improved in production efficiency and decreased in generation of spot-patterns, etc.

In the sheet manufacturing apparatus according to the aforementioned applied example, the flow velocity of defibrated fibers when the air permeability with respect to the thickness of the defibration object is a first case is lowered than the flow velocity of the defibrated material when the air permeability with respect to the thickness of the defibration object is smaller than the first case.

When the air permeability is larger in a defibration object having a certain thickness, a relatively larger amount of foreign substances is contained. The flow velocity of defibrated material in the classifying unit is further lowered. With this, as compared with the case in which the flow velocity of defibrated material in the classifying unit is higher, the centrifugal force applied to defibrated material is weakened, which enables an easy removal of foreign substances contained in the defibrated material. On the other hand, when the air permeability is smaller in a defibration object having a certain thickness, the content rate of foreign substances is relatively lower. So, in this case, the flow velocity of defibrated material in the classifying unit is further increased. With this, as compared with the case in which the flow velocity of defibrated material in the classifying unit is lower, the centrifugal force applied to the defibrated material increases. So, although the removal efficiency of foreign substances is reduced, the foreign substance content rate is originally low, and therefore there arises no quality problem. On the other hand, in this case, the removal rate of defibrated fibers is reduced, and the collection rate of defibrated fibers improves. With this, it becomes possible to attain an apparatus control considering the balance between foreign substance removal and defibrated fiber collection.

In the sheet manufacturing apparatus according to the aforementioned applied example, a first flow passage and a second flow passage that are different in pipe diameter and connect the defibrating unit and the classifying unit are provided, and a pipe diameter of the first flow passage for passing the defibrated material when the air permeability with respect to the thickness of the defibration object is the first case is larger than a pipe diameter of the second flow passage for passing the defibrated material when the air permeability with respect to the thickness of the defibration object is smaller than the first case.

When the air permeability in a defibration object having a certain thickness is larger, a relatively larger amount of foreign substances is contained. So, defibrated material is caused to pass through a passage having a larger pipe diameter (inner diameter) among a plurality of passages connected to the classifying unit to be fed to the classifying unit. With this, as compared with the case in which defibrated material is caused to pass through a passage having a passage smaller in pipe diameter (inner diameter), the flow velocity of defibrated material in the classifying unit can be further lowered.

With this, the centrifugal force applied to the defibrated material in the classifying unit is weakened, and therefore the foreign substances contained in the defibrated material can be easily removed. On the other hand, in the case in which the air permeability in a defibration object having a certain thickness is smaller, the content rate of foreign substances is relatively lower. So, in this case, the defibrated material is caused to pass through a passage smaller in pipe diameter to be fed to the classifying unit. With this, as compared with the case in which the flow velocity of defibrated material in the classifying unit is lower, the centrifugal force applied to the defibrated material increases. So, although the removal efficiency of defibrated material decreases, the foreign substance content rate is originally low, and therefore there arises no quality problem. Rather, in this case, the removal rate of defibrated fibers decreases, and the collection rate of defibrated fibers improves. Thus, it becomes possible to attain an apparatus control considering the balance between the removal of foreign substances and the collection of defibrated fibers.

In the sheet manufacturing apparatus according to the aforementioned applied example, a suction portion connected to the classifying unit to suck the foreign substances is provided, and a suction power of the suction portion when the air permeability with respect to the defibration object is the first case is weaker than a suction power of the suction portion when the air permeability with respect to the thickness of the defibration object is smaller than the first case.

When air permeability is lager in a defibration object having a certain thickness, a relatively more amount of foreign substances are contained. So, the suction power of the suction unit connected to the classifying unit is weakened. By this, the centrifugal force applied to the defibrated material in the classifying unit is weakened, which enables an easy removal of foreign substances contained in the defibrated material. On the other hand, when air permeability is smaller in a defibration object having a certain thickness, the content rate of foreign substances is relatively low. So, in this case, the suction power of the defibrated material in the classifying unit is increased. With this, as compared with the case in which the flow velocity of defibrated material in the classifying unit is lower, the centrifugal force applied to the defibrated material increases. So, although the flow velocity of defibrated material decreases, the foreign substance content rate is originally low, and therefore there arises no quality problem. Rather, in this case, the removal rate of defibrated fibers decreases, and the collection rate of defibrated fibers improves. Thus, it becomes possible to attain an apparatus control considering the balance between the removal of foreign substances and the collection of defibrated fibers.

BRIEF DESCRIPTION OF THE DRAWINGS

Referring now to the attached drawings which form a part of this original disclosure.

DETAILED DESCRIPTION OF EXEMPLARY EMBODIMENTS

The present invention was made to solve at least a part of the aforementioned objects, and is capable of actualizing as the following embodiments or applied examples. Hereinafter, first and second embodiments of the present invention will be explained with reference to figures. In each of the following figures, the scale of each member, etc., is shown so as to be different from the actual scale to make each member, etc., recognizable size.

First Embodiment

Initially, a structure of a sheet manufacturing apparatus will be explained. The sheet manufacturing apparatus is provided with a measuring unit for measuring the thickness and the air permeability of a defibration object, a defibrating unit for dry-defibrating the defibration object, and a classifying unit for separating and removing foreign substances other than fibers contained in a defibrated material defibrated by the defibrating unit by airflow classification. Further, it is an apparatus for controlling a flow velocity of the defibrated material passing through the classifying unit depending on the measured results of the measuring unit.

The sheet manufacturing apparatus according to this embodiment is based on a technology for reproducing a stock material containing fibers into a new sheet. The stock material as a defibration object to be supplied to the sheet manufacturing apparatus according to this embodiment is, for example, used paper PU or a pulp sheet of A4 size, etc., which are a mainstream size in offices. Hereinafter, concrete explanation will be made.

Figure 1:
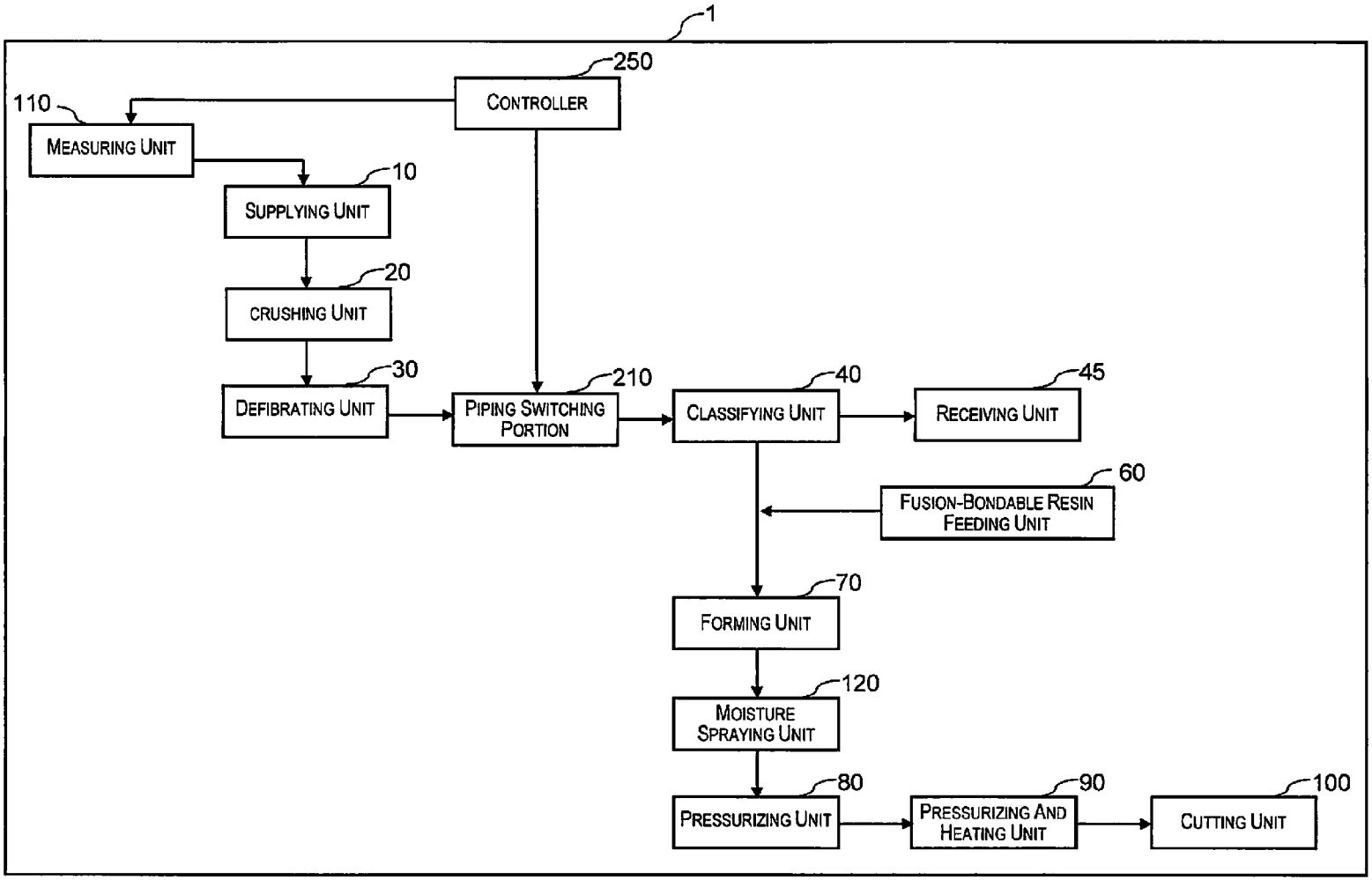
FIG. 1 is a schematic view showing a structure of a sheet manufacturing apparatus according to a first embodiment.
Figure 2:
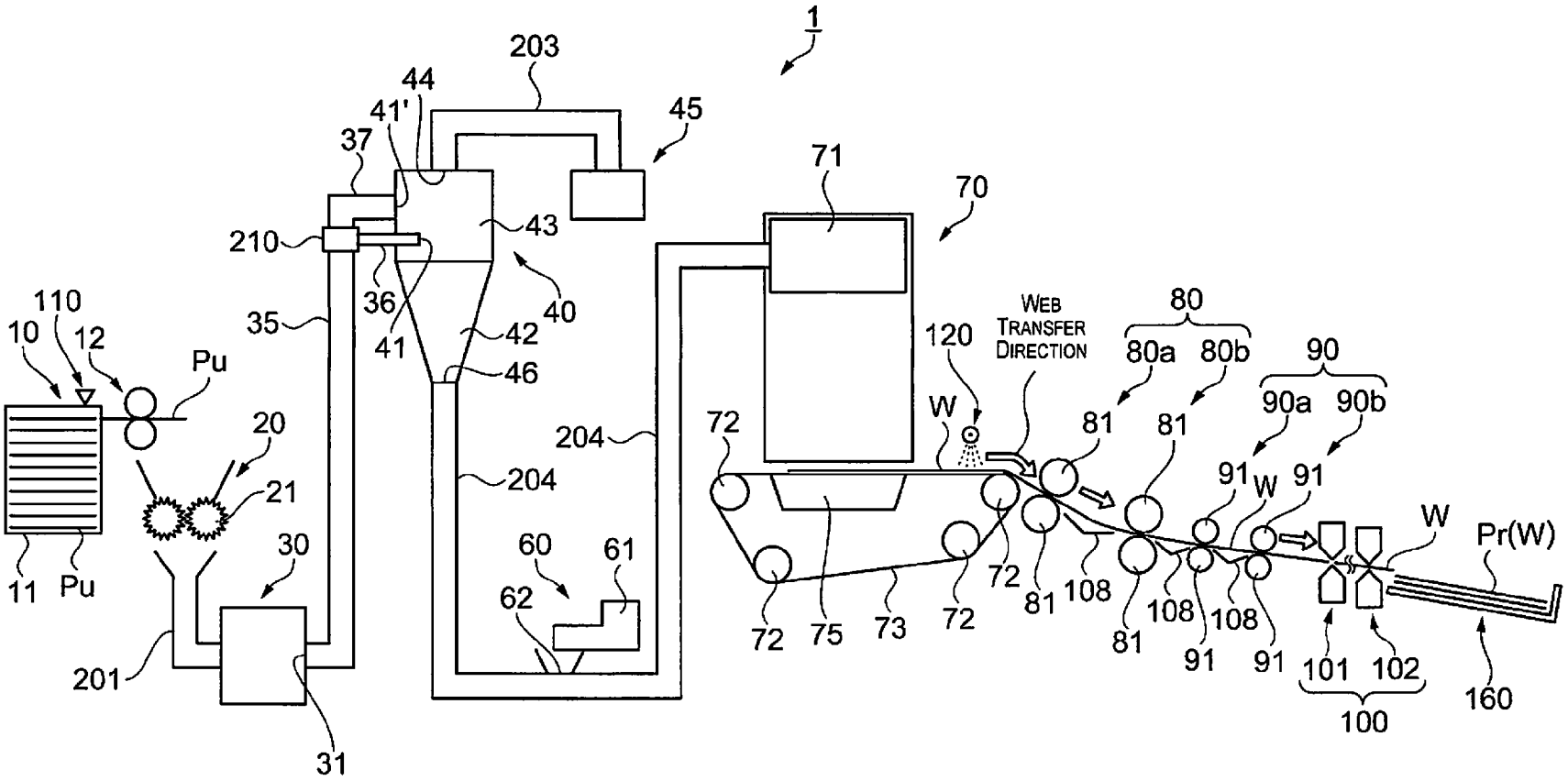
FIG. 2 is another schematic view showing the structure of the sheet manufacturing apparatus according to the first embodiment.
Figure 3:
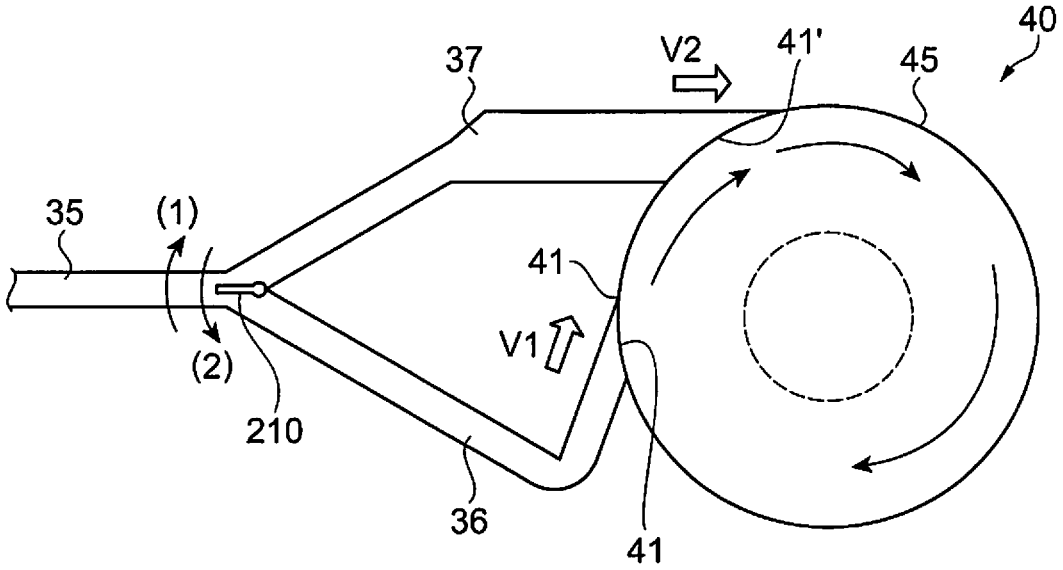
FIG. 3 is a detail view showing the partial structure of the sheet manufacturing apparatus according to the first embodiment.

FIGS. 1 and 2 are schematic views showing the structure of a sheet manufacturing apparatus according to this embodiment. FIG. 3 is a detail view showing a partial structure of the sheet manufacturing apparatus according to this embodiment, which is a perspective plan view of a partial structure of the sheet manufacturing apparatus.

As shown in FIGS. 1 and 2, the sheet manufacturing apparatus 1 is provided with a supplying unit 10, a crushing unit 20, a defibrating unit 30, a classifying unit 40, a receiving unit 45, a fusion-bondable resin feeding unit 60, a forming unit 70, a moisture spraying unit 120, a pressurizing unit 80, a pressurizing and heating unit 90, and a cutting unit 100. The apparatus is further provided with a measuring unit 110 for measuring the thickness and the air permeability of a defibration object. The apparatus is further provided with a controller 250 for controlling these members.

The supplying unit 10 supplies a stock material Pu as a defibration object to the crushing unit 20. The supplying unit 10 is provided with a tray 11 for loading a plurality of stock material Pu thereon in a stacked manner, an automatic feeder 12 capable of continuously feeding the stock material Pu loaded on the tray 11 to the crushing unit 20, etc.

The measuring unit 110 measures the thickness and the air permeability of the stock material Pu to be supplied to the crushing unit 20. The measuring unit 110 further derives the content rate of foreign substances contained in the stock material Pu based on the thickness and the air permeability of the stock material Pu to be supplied. Depending on the derived content rate of the foreign substances of the stock material Pu, the operating conditions (flow velocity of the defibrated material) of the classifying unit 40 (cyclone 40) described below are changed.

Here, the wording of "air permeability" denotes a time required for a certain amount of air to pass through a certain area of a stock material under a certain pressure. The stock material Pu to be introduced into the sheet manufacturing apparatus 1 is constituted mainly by pulp fibers, and the air permeability is proportionate to the thickness of the stock material Pu. However, if foreign substances (substances other than fibers, such as, e.g., coated layer, adhesive agent, laminate layer, tonner loading material) are contained in the stock material Pu, since these foreign substances are very small in particles as compared with pulp fibers, the air permeability of the stock material Pu increases. In other words, in cases where the stock material contains a larger amount of foreign substances (when the content rate of foreign substances is high) with respect to a stock material having a certain thickness, the air permeability increases (aeration property deteriorates). On the other hand, in cases where there exists a smaller amount of foreign substances (when the content rate of foreign substances is low), the air permeability decreases (aeration property improves).

The measuring unit 110 of this embodiment includes a thickness measuring portion for measuring the thickness of a stock material Pu and an air permeability measuring portion for measuring the air permeability of the stock material Pu. The measuring unit 110 includes a data table for storing the content rate of foreign substances contained in the stock material Pu from the measured thickness and air permeability of the stock material Pu.

Therefore, the measuring unit 110 can obtain the content rate of foreign substances contained in the stock material Pu based on the thickness of the stock material Pu measured by the thickness measuring portion and the air permeability of the stock material Pu measured by the air permeability measuring portion by reference to the data table. What is to be obtained can be the content of foreign substances instead of the content rate thereof, or data showing how large or small the content rate or content is.

The crushing unit 20 cuts the supplied stock material Pu into small square pieces of several centimeters. The crushing unit 20 is provided with a crushing blade 21, constituting a device including a shredding blade having a width wider than a width of a normal shredder. With this, the supplied stock material Pu can be easily cut into small pieces. The small pieces are supplied to a defibrating unit 30 via piping 201.

The defibrating unit 30 is provided with a rotatable rotary blade, and is configured to defibrate the small pieces (defibration object) supplied from the crushing unit 20 into a fibrous (cotton-like) form (defibrating process) and discharge the defibrated material from the discharge port 31 to the classifying unit 40.

The defibrating unit 30 of this embodiment performs a dry-type defibrating operation to be performed not in water but in air. In the defibrating unit 30, a dry-type defibrating apparatus equipped with, for example, a disk refiner, a Turbo-Mill (made by Turbo Kogyo Co., Ltd.), a Ceren-Miller (made by Masuko Sangyo Co., Ltd), and/or a wind generation mechanism can be arbitrarily applied. The size of small piece to be introduced to the dry-type defibrating unit 30 can be a size similar to a size of a piece discharged from a normal shredder.

By the defibrating processing by the defibrating unit 30, foreign substances, such as, e.g., printed ink, tonner, blot inhibitor, will be also released from the state in which the foreign substances are adhered to fibers. Therefore, the defibrated material discharged from the defibrating unit 30 contain fibers obtained by defibrating the small pieces and foreign substances. The defibrating unit 30 of this embodiment has a mechanism in which airflow is generated by the rotation of the rotary blade, and the defibrated material is transferred to the classifying unit 40 by being carried by the airflow. In the case of using a dry-type defibrating unit not equipped with a wind generation mechanism, it is recommended to separately provide an airflow generator for generating airflow from the crushing unit 20 toward the defibrating unit.

Now, the connection structure of the defibrating unit 30 and the classifying unit 40 will be explained. As shown in FIG. 2 and FIG. 3, a piping 35 for transferring the defibrated material from the discharge port 31 toward the classifying unit 40 is connected to the defibrating unit 30. The piping 35 is, in the longitudinal middle portion thereof, branched to a first piping 36 and a second piping 37. In FIG. 2, although the first piping 36 and the second piping 37 are different in height, they can be arranged at the same height, or the second piping 37 can be arranged at a position lower than the first piping 36.

The first piping 36 is connected to a first inlet port 41 provided at the cylindrical portion 43 of the below-mentioned classifying unit 40, and the second piping 37 is connected to a second inlet port 41' provided at the cylindrical portion 43 of the below-mentioned classifying unit 40. At the branched portion of the first piping 36 and the second piping 37, a piping switching portion 210 having a valve is provided. The pipe diameter of the first piping 36 is set to be smaller than the pipe diameter of the second piping 37. By switching of the piping switching portion 210, the defibrated material discharged from the defibrating unit 30 can be transferred to the classifying unit 40 via the first piping 36 or the second piping 37.

Concretely, as shown in FIG. 3, it is configures as follows. When the valve of the piping switching portion 210 is switched to the side (1), the airflow flows into the first inlet port 41 of the classifying unit 40 via the first piping 36. On the other hand, when the valve of the piping switching portion 210 is switched to the side (2), the airflow flows into the second inlet port 41' of the classifying unit 40 via the second piping 37.

Further, since the flow amount of the air containing defibrated material in the piping 35 is constant, the flow velocity flowing from the first inlet port 41 to the classifying unit 40 via the first piping 36 small in pipe diameter increases. On the other hand, the flow velocity of the air flowing from the second inlet port 41' to the classifying unit 40 via the second piping 37 large in pipe diameter decreases.

The classifying unit 40 is to separate the defibrated material into fibers and foreign substances by airflow classification and remove the foreign substances. In the classifying unit 40 of this embodiment, a cyclone 40 is employed as the classifying unit 40 to airflow-classify the transferred defibrated material into foreign substances and fibers. The wording of "foreign substances" denotes, for example, an adhesive agent, a coated layer, a laminate layer, tonner contained in used paper, or non-fibers among the defibrated material subjected to a defibrating process, such as, e.g., loading materials contained in a pulp sheet.

As the classifying unit 40, an airflow-type classifier of another type can be used in place of the cyclone 40. In this case, as an airflow-type classifier other than the cyclone 40, for example, an Elbow-Jet, an EID classifier, etc., can be used. An airflow-type classifier generates swirling airflow to perform separation and classification by the difference of the received centrifugal force due to the size and density of the defibrated material, and can adjust the classification point by adjusting the airflow velocity and/or the centrifugal force.

The cyclone 40 is preferably a tangent input system cyclone which is relatively simple in structure. As shown in FIG. 2, the cyclone 40 of this embodiment is constituted by a cylindrical portion 43 to which the first inlet port 41 (second inlet port 41') continuing from the defibrating unit 30 is connected in a tangential direction, a conical portion 42 continued from the cylindrical portion 43, a lower outlet 46 provided at the lower portion of the conical portion, and an upper exhaust port 44 provided at the upper central portion of the cylindrical portion 43 to discharge fine powder.

In the classification processing, the airflow carrying defibrated material introduced from the first inlet port 41 (second inlet port 41') of the cyclone 40 is changed into a circular movement at the cylindrical portion 43 and then moved to the conical portion 42. Depending on the difference of the centrifugal force received by the size and the density of the defibrated material, separation and classification are performed.

When classified the substances contained in the defibrated material into two types, fibers and foreign substances other than the fibers, fibers are larger in size or higher in density than foreign substances. For this reason, the defibrated material is separated into foreign substances smaller in size and lower in density than fibers and fibers larger in size and higher in density than foreign substances by the classification processing. The separated foreign substances are introduced to the upper exhaust port 44 as fine powder together with air.

From the upper exhaust port 44 of the cyclone 40, foreign substances relatively lower in density are discharged. In some cases, the foreign substances relatively lower in density include relatively short fibers.

The discharged foreign substances are collected by the receiving unit 45 from the upper exhaust port 44 of the cyclone 40 via the piping 203. On the other hand, fibers lager in size and higher in density are transferred as defibrated fibers from the lower outlet 46 of the cyclone 40 toward the forming unit 70.

The defibrated fibers are whiter than defibrated material because foreign substances were removed from the state of defibrated material and deinking was performed. Further, the defibrated fibers are larger in the content rate of fibers than the defibrated material, and therefore the strength can be easily increased at the time of forming a sheet.

In the middle of the piping 204 through which the defibrated fibers are transferred from the cyclone 40 to the forming unit 70, a fusion-bondable resin feeding unit 60 for feeding fusion-bondable resin to the defibrated fibers is provided. The fusion-bondable resin is, at the time of forming a sheet, to connect fibers with each other to secure the strength, and to prevent scattering of paper powder/fibers. By being added to defibrated fibers and heated, the fusion-bondable resin is secured to the defibrated fibers. The fusion-bondable resin can be in any form such as a fibrous form or a powder form as long as it can melt by being heated, but is preferably a resin which can melt at 200° C. or below, more preferably 160° C. or below. The fusion-bondable resin is stored in a storing portion 61 and fed from the feeding port 62 by a non-illustrated feeding mechanism.

In the same manner as mentioned above, in the middle of the piping 204 through which defibrated fibers are transferred from the cyclone 40 to the forming unit 70, an additive agent feeding portion for feeding additive agents such as a whiteness enhancer or a paper strengthening agent to the defibrated fibers can be provided. As the whiteness enhancer, it is preferable to use, for example, an agent containing at least one of calcium carbonate, clay, kaolin, talc, silica, titanium oxide, barium sulfate, and starch. Further, as the paper strengthening agent, it is preferable to use an agent containing at least one of polyacrylamide, polyamide epichlorohydrin, polyvinyl alcohol and starch. Further, when needed, a sizing agent can be fed to the defibrated fibers. As the sizing agent, polyacrylamide, polyvinyl alcohol, alkyl ketene dimer, alkenyl succinic anhydride, rosin soap, etc., can be used. With this, when the defibrated fibers are formed into a sheet, blurring can be prevented.

Materials in which a fusion-bondable resin and/or an additive agent are fed to defibrated fibers transferred from the cyclone 40 in the middle of the piping 204 are called "material fibers." In the sheet manufacturing apparatus 1, a sheet is formed using material fibers.

The forming unit 70 is configured to deposit the material fibers to have an even thickness. The forming unit 70 includes a mechanism for evenly dispersing the material fibers in the air and a mechanism for sucking the material fibers on a mesh belt.

As the mechanism for evenly dispersing the material fibers in the air, in the forming unit 70, a forming drum 71 into which the material fibers are fed is arranged. A porous screen is provided on the surface of the forming drum 71. By rotating the forming drum 71 to make the material fibers pass through the porous screen, the material fibers can be evenly dispersed in the air. Further, by rotating the forming drum 71, the fusion-bondable resin (additive agent) can be mixed evenly in the fibers.

On the other hand, vertically down below the forming drum 71, an endless mesh belt 73 in which a mesh is formed is arranged. The mesh belt 73 is tensioned by a plurality of stretching rollers 72, and is configured to move the mesh belt 73 in one direction by rotating at least one of the stretching rollers 72.

Further, vertically below the forming drum 71, a suction apparatus 75 for generating airflow vertically downward is provided via the mesh belt 73. By the suction apparatus 75, the material fibers dispersed in the air can be sucked on the mesh belt 73.

When the material fibers are introduced into the forming drum 71 of the forming unit 70, the material fibers pass through the porous screen on the surface of the forming drum 71 and are deposited on the mesh belt 73 by the suction power of the suction apparatus 75. At this time, by moving the mesh belt 73 in one direction, the material fibers can be deposited with a uniform thickness. The accumulated deposit containing the material fibers is called web W. The mesh belt 73 can be made of metal, resin, or nonwoven fabric, and can be any member as long as it allows deposition of material fibers and also allows passage of airflow. If the aperture diameter of the mesh is too large, when forming a sheet, unevenness is easily formed on the surface of the sheet. If the aperture diameter of the mesh is too small, it becomes hard to attain stable airflow by the suction apparatus 75. For this reason, it is preferable to appropriately adjust the aperture diameter of the mesh. The suction apparatus 75 can be formed by forming a sealed box having an opening of a desired size below the mesh belt 73 and sucking the air in the box from a portion other than the opening to vacuum the inside of the box.

The web W is transferred in the web transfer direction shown by the arrow in FIG. 2 by moving the mesh belt 73. The moisture spraying unit 120 is to spray moisture toward the web W to be transferred. With this, hydrogen bonding between fibers can be enhanced. The web W to which moisture was sprayed is transferred to the pressurizing unit 80.

The pressurizing unit 80 is to pressurize the transferred web W. The pressurizing unit 80 is provided with two pairs of pressure rollers 81. By making the web W to which moisture was sprayed pass through between the opposed pressure rollers 81, the web W is compressed. The compressed web W is transferred to the pressurizing and heating unit 90.

The pressurizing and heating unit 90 simultaneously performs pressurizing and heating of the transferred web W. The pressurizing and heating unit 90 is provided with two pairs of heating rollers 91. By making the compressed web W pass through between the opposed heating rollers 91, the web is heated and pressurized.

In a state in which the distance between fibers is shortened and the number of contacts between fibers is increased by the pressure rollers 81, the fusion-bondable resin is molten by the heating rollers 91 to connect fibers with each other. This enhances the strength as a sheet and dehydrates to remove excessive moisture, enabling a production of an excellent sheet. The heating is preferably performed by arranging heaters in the heating rollers 91 to simultaneously perform pressurizing and heating of the web W. Below the pressure rollers 81 and the heating rollers 91, guides 108 for guiding the web W are arranged.

The web W obtained as mentioned above is transferred to the cutting unit 100. The cutting unit 100 is provided with a cutter 101 for cutting the web in the transfer direction and a cutter 102 for cutting the web in a direction perpendicular to the transfer direction, so that the web W formed in an elongated manner is cut into a desired size. The cut web W is stacked as sheets Pr on the stacker 160.

Next, a control method of the sheet manufacturing apparatus 1 will be explained. Concretely, the control method of controlling the flow velocity of defibrated material passing through the cyclone depending on the measured results of the measuring unit 110 will be explained based on the flow chart of FIG. 4. The control method in the case in which the measured result of the measuring unit 110 of this embodiment is a content rate of foreign substances contained in the defibration object (stock material) will be explained.

The controller 250 drives the measuring unit 110 to make the measuring unit 110 measure the thickness and the air permeability of the stock material as an defibration object to be fed from the supplying unit 10 to the crushing unit 20 (Step S1).

Then, based on the measured results of the thickness and the air permeability of the stock material, the content rate of foreign substances (foreign substance content rate) contained in the stock material is calculated from the data table (Step S2).

Then, depending on the calculated foreign substance content rate of the stock material, the flow velocity of the defibrated material passing through the cyclone 40 is controlled.

Figures 4, 5:
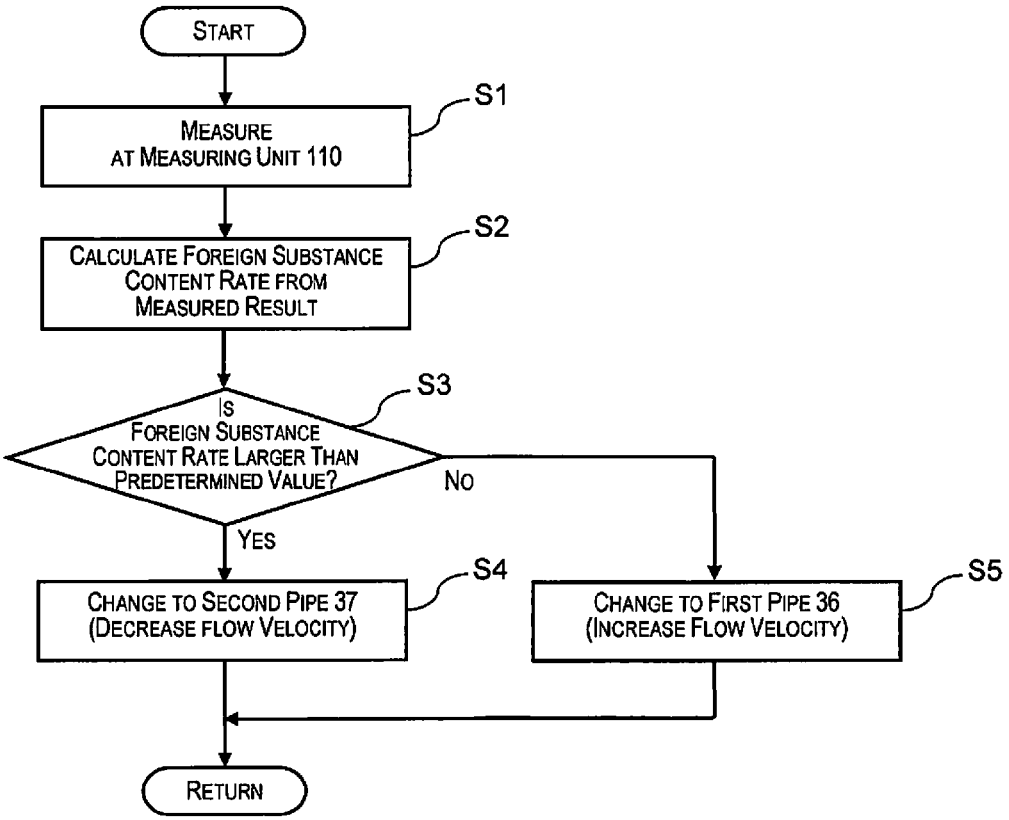
FIG. 4 is a flow chart showing the control according to the first embodiment.
FIG. 5 shows data showing the collection rates of foreign substances and defibrated fibers of the sheet manufacturing apparatus according to the first embodiment.

The collection rates of defibrated fibers and foreign substances depending of the foreign substance content rate of the defibrated material and the flow velocity of the defibrated material will be explained. FIG. 5 shows the data of collection rates of the defibrated fibers and the foreign substances of the sheet manufacturing apparatus 1 according to this embodiment. In both of a case in which the content rate (35 wt %) of foreign substances in the defibrated material is large and a case in which the content rate (10 wt %) of foreign substances in the defibrated material is small, the collection rates of the defibrated fibers and the foreign substances when passed through the first inlet port 41 and the second inlet port 41' are shown. As mentioned above, the first inlet port 41 is higher in the flow velocity flowing into the cyclone than the second inlet port 41'.

Here, the collection rate of foreign substances denotes a rate of collection from the classifying unit 40 to the receiving unit 45. The larger the rate is, the more the foreign substances are collected. When all of foreign substances in the defibrated material are collected to the receiving unit 45, the collection rate is 100%.

The collection rate of defibrated fibers shows a rate of transferring from the classifying unit 40 to the forming unit 70. The larger the rate is, the more the defibrated fibers are transferred to the forming unit 70. When all of fibers in the defibrated material are transferred to the forming unit 70, the collection rate is 100%.

In this embodiment, when the collection rate of the foreign substances and that of the defibrated fibers are 90% or more respectively, it is judged as PASSED, and when less than 90%, it is judged as FAILED (showed by shading).

As shown in FIG. 5, regardless of the foreign substance content rate of the defibrated material, the collection rate (%) of foreign substances was higher in the case of introducing from the second inlet port 41' than in the case of introducing from the first inlet port 41. From the viewpoint of the collection rate of foreign substances, the collection rate is better when the flow velocity flowing into the cyclone 40 is lower.

However, judging from the collection rate of defibrated fibers, in the case of the second inlet port 41' and the content rate of foreign substances of 10 wt %, the collection rate was 87% which was judged as FAILED, while in the case of the second inlet port 41' and the content rate of foreign substances of 35 wt %, the collection rate was more than 90% which was judged as PASSED. The reasons to become FAILED is that if the content rate of foreign substances is low in a state in which the flow velocity flowing to the cyclone 40 is low, not only foreign substances but also a part of defibrated fibers are discharged from the upper exhaust port 44.

On the other hand, regardless of the foreign substance content rate of the defibrated material, the collection rate of defibrated fibers was higher in the case of introducing from the first inlet port 41 than in the case of introducing from the second inlet port 41'. From the viewpoint of collection rate of defibrated fibers, it is concluded that the collection rate of defibrated fibers is better in the case in which the flow velocity flowing into the cyclone 40 is higher.

However, judging from the collection rate of foreign substances, in the case of the first inlet port 41 and the content rate of foreign substances of 35 wt %, the collection rate was 80% which was judged as FAILED, while in the case of the first inlet port 41 and the content rate of foreign substances of 10 wt %, the collection rate was more than 90% which was judged as PASSED. The reason to become FAILED is that if the content rate of foreign substances is high in a state in which the flow velocity flowing to the cyclone 40 is high, foreign substances are not sufficiently collected.

As will be understood from the aforementioned results, in the classifying unit 40, all of foreign substances cannot be collected from the defibrated material. Further, there is a case in which foreign substances are mixed in defibrated fibers. Further, from a viewpoint of collecting one of foreign substances and defibrated material more than the other, there is a case that the other becomes FAILED. In order to bring both of foreign substances and defibrated fibers to PASSED, when the content rate of foreign substances is low, the flow velocity flowing into the cyclone 40 is increased, while when the content rate of foreign substances is high, the flow velocity flowing into the cyclone 40 is decreased.

As the control method of the sheet manufacturing apparatus 1, depending on the foreign substance content rate of the stock material (defibration object) calculated in Step S2 shown in FIG. 4, the flow velocity of defibrated material passing through the cyclone 40 is controlled as follows.

The controller 250 judges whether or not the air permeability with respect to the thickness of the stock material is larger than a predetermined value, that is, whether or not the foreign substance content rate of the stock material is larger than a predetermined value (Step S3), and controls the piping switching portion 210.

If the air permeability with respect to the thickness of the stock material is larger than the predetermined value (Step S3: YES), that is, if the foreign substance content rate of the stock material is large, the piping switching portion 210 is switched to the side (2) to make the defibrated material flow into the second inlet port 41' of the cyclone 40 via the second piping 37 larger in pipe diameter (Step S4). With this, it becomes possible to decrease (weaken) the flow velocity flowing into the cyclone 40 than in the case in which the air permeability with respect to the thickness of the stock material is smaller than the predetermined value, that is, in the case in which the foreign substance content rate of the stock material is smaller than the predetermined value. With this, the centrifugal force applied to the defibrated fibers and the foreign substances in the cyclone 40 decreases, resulting in an easy collection of the foreign substances light in weight from the upper exhaust port 44 of the cyclone 40, which enhances the collection efficiency of foreign substances.

On the other hand, if the air permeability with respect to the thickness of the stock material is small (Step S3: NO), that is, if the content rate of foreign substances in the stock material is small, the piping switching portion 210 is switched to the side (1) to make the defibrated material flow into the first inlet port 41 of the cyclone 40 via the first piping 36 small in pipe diameter (Step S5). With this, it becomes possible to increase the flow velocity flowing into the cyclone 40 than in the case in which the air permeability with respect to the thickness of the stock material is larger than the predetermined value, that is, in the case in which the foreign substance content rate of the stock material is larger than the predetermined value. With this, the centrifugal force applied to the defibrated fibers and the foreign substances in the cyclone 40 increases, which controls the movement of the foreign substances toward the upper exhaust port 44 of the cyclone 40 (i.e., controls the deinking processing capacity). Therefore, defibrated fibers and foreign substances are easily moved to the lower outlet 46 of the cyclone 40, resulting in an improved collection rate of defibrated fibers.

According to the aforementioned embodiment, the following effects can be obtained.

(1) Depending on the foreign substance content rate of the stock material (defibration object), for example, if the content rate of foreign substances contained in the stock material is larger than a predetermined value, the defibrated material is introduced from the second inlet port 41' to the cyclone 40 via the second piping 37 large in pipe diameter. With this, the flow velocity in the cyclone 40 decreases, which enables collection of defibrated fibers while collecting foreign substances. Further, in the case in which the content rate of foreign substances contained in the stock material is smaller than a predetermined value, the defibrated fibers are introduced from the first inlet port 41 to the cyclone 40 via the first piping 36 small in pipe diameter. With this, the flow velocity in the cyclone 40 increases, which enables collection of defibrated fibers while collecting foreign substances.

As mentioned above, by changing or adjusting the flow velocity of the defibrated material in the cyclone 40 depending on the foreign substance content rate of the stock material, the collection of foreign substances and the collection of defibrated fibers can be balanced, the production efficiency can be enhanced, and further a high-quality sheet can be produced.

Second Embodiment

Figure 6:
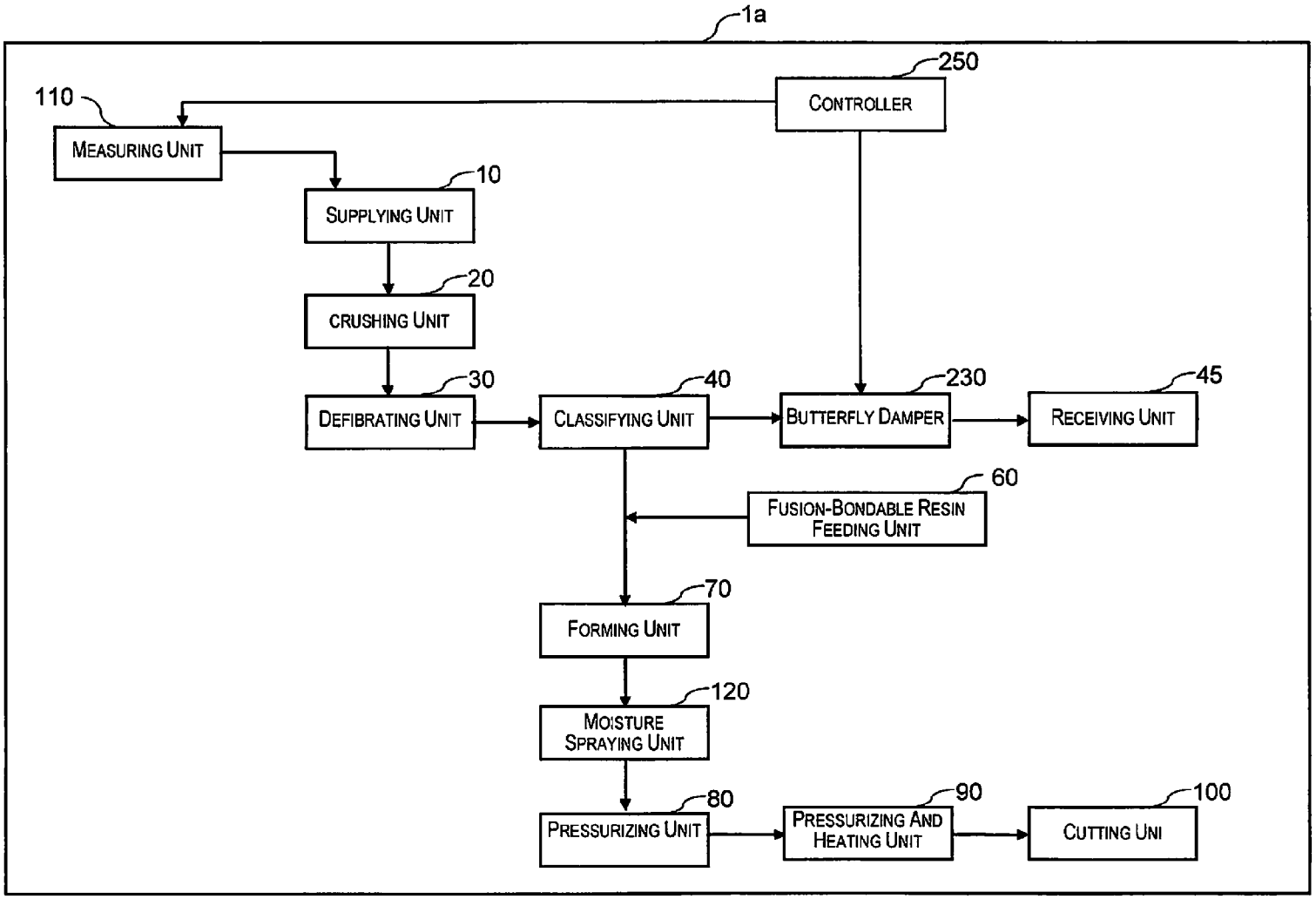
FIG. 6 is a schematic view showing a structure of a sheet manufacturing apparatus according to a second embodiment.
Figure 7:
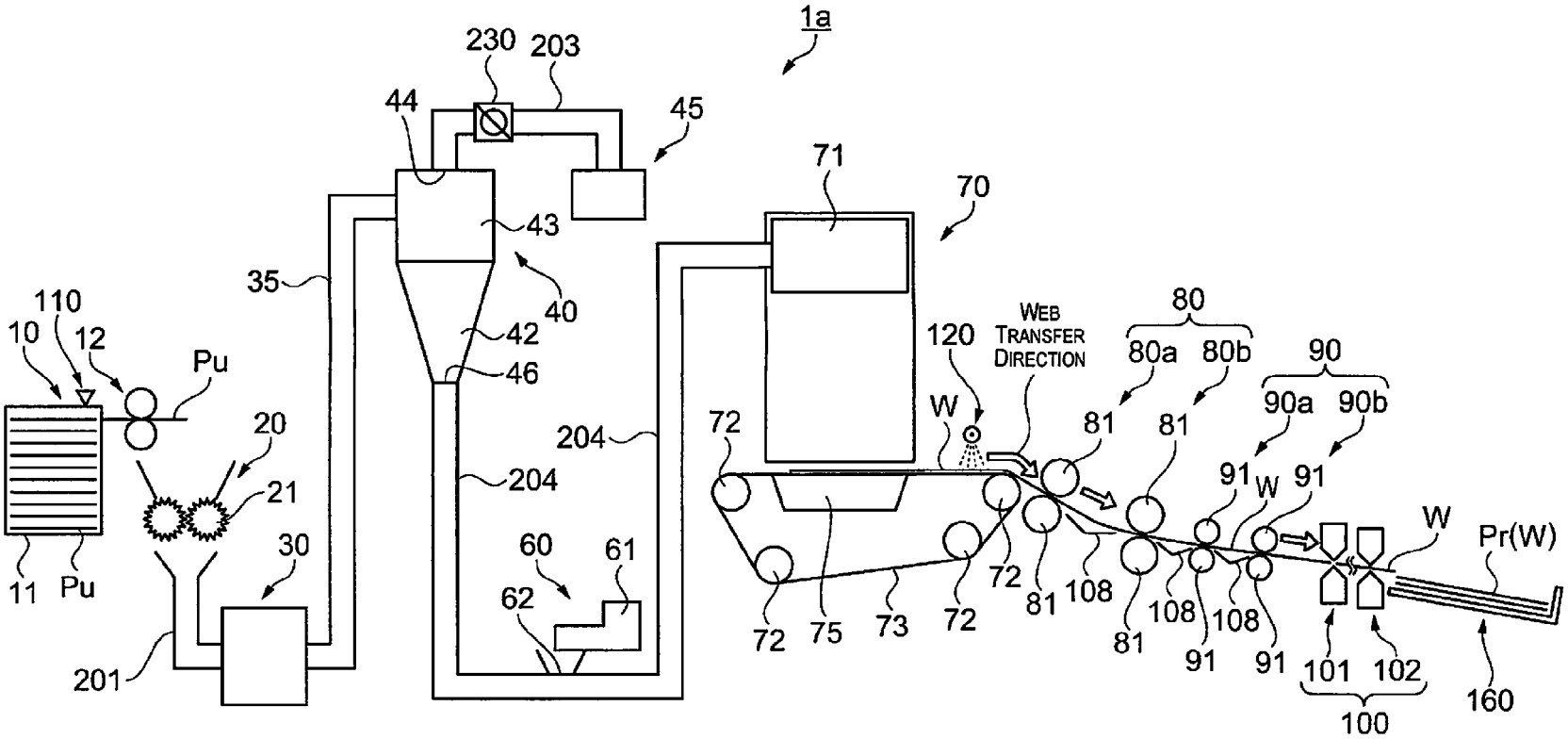
FIG. 7 is another schematic view showing the structure of the sheet manufacturing apparatus according to the second embodiment.

Next, an explanation will be made on a second embodiment. FIGS. 6 and 7 are schematic views showing the structure of a sheet manufacturing apparatus according to this embodiment. As shown in FIGS. 6 and 7, the sheet manufacturing apparatus 1*a* is provided with a supplying unit 10, a crushing unit 20, a defibrating unit 30, a classifying unit 40, a receiving unit 45, a fusion-bondable resin feeding unit 60, a forming unit 70, a moisture spraying unit 120, a pressurizing unit 80, a pressurizing and heating unit 90, and a cutting unit 100. The apparatus is further provided with a measuring unit 110 for measuring the thickness and the air permeability of a defibration object. The apparatus is further provided with a controller 250 for controlling these members. Further, in this embodiment, different from the structure of the first embodiment, a butterfly damper 230 is provided between the classifying unit 40 and the receiving unit 45. As to the same structures as in the first embodiment, the explanation will be omitted by allotting the same reference symbol.

In the first embodiment, depending on the foreign substance content rate of the stock material, the inlet port to the cyclone 40 is selected between the first inlet port 41 and the second inlet port 41' to flow the defibrated material to thereby change the operating conditions (flow velocity of defibrated material) of the cyclone 40. In this embodiment, the number of the inlet port to the cyclone 40 is set to one, and further the butterfly damper 230 is provided between the cyclone 40 and the receiving unit 45. With this, it is structured such that the exhaust amount of the airflow flowing through the piping 203 communicating the upper exhaust port 44 of the cyclone 40 and the receiving unit 45 can be changed by the opening rate of the butterfly damper 230. In other words, this embodiment is different from the first embodiment in that it is structured such that the flow velocity of defibrated material can be adjusted by the opening rate of the butterfly damper 230.

Next, a control method of the sheet manufacturing apparatus 1*a* will be explained based on the flow chart of FIG. 8. Concretely, a control method for controlling the flow velocity of defibrated material passing through the cyclone depending on measured results of the thickness and the air permeability of the defibration object measured by the measuring unit 110 will be explained.

Initially, the controller 250 drives the measuring unit 110 to make the measuring unit 110 measure the thickness and the air permeability of the stock material as an defibration object to be fed from the supplying unit 10 to the crushing unit 20 (Step S11).

Then, based on the measured results of the thickness and the air permeability of the stock material, the content rate of foreign substances (foreign substance content rate) contained in the stock material is calculated from the data table (Step S12).

Then, depending on the calculated foreign substance content rate, the flow velocity of the defibrated material passing through the cyclone 40 is controlled.

The controller 250 judges whether or not the air permeability with respect to the thickness of the stock material is larger than a predetermined value, that is, whether or not the foreign substance content rate of the stock material is larger than a predetermined value (Step S13), and controls the butterfly damper 230.

If the air permeability with respect to the thickness of the stock material is larger than the predetermined value (Step S13: YES), that is, if the foreign substance content rate of the stock material is larger than the predetermined value, the opening rate of the butterfly damper 230 is increased (Step S14). With this, it becomes possible to decrease (weaken) the flow velocity of defibrated material than in the case in which the air permeability with respect to the thickness of the stock material is smaller than the predetermined value, that is, in the case in which the foreign substance content rate of the stock material is smaller than the predetermined value. This decreases the flow velocity of the defibrated material in the cyclone 40. With this, the centrifugal force applied to the defibrated fibers and the foreign substances in the cyclone 40 decreases, resulting in an easy collection of foreign substances lower in density than fibers from the upper exhaust port 44 of the cyclone 40, which enhances the collection efficiency of foreign substances.

On the other hand, if the air permeability with respect to the thickness of the stock material is smaller than a predetermined value (Step S13: NO), that is, if the foreign substance content rate of the stock material is smaller than a predetermined value, the opening rate of the butterfly damper 230 is decreased (Step S15). With this, it becomes possible to increase the flow velocity of the defibrated material than in the case in which the air permeability with respect to the thickness of the stock material is larger than the predetermined value, that is, in the case in which the foreign substance content rate of the stock material is larger than the predetermined value, which increases the flow velocity of defibrated material in the cyclone 40. With this, the centrifugal force applied to the defibrated fibers and the foreign substances in the cyclone 40 increases, which controls the movement of the foreign substances toward the upper exhaust port 44 of the cyclone 40 (i.e., controls the deinking processing capacity). Therefore, defibrated fibers and foreign substances are easily moved to the lower outlet 46 of the cyclone 40, resulting in an improved collection rate of defibrated fibers.

Here, the collection rate of foreign substances and defibrated fibers by the opening rate of the butterfly damper 230 will be explained.

Figures 8, 9:
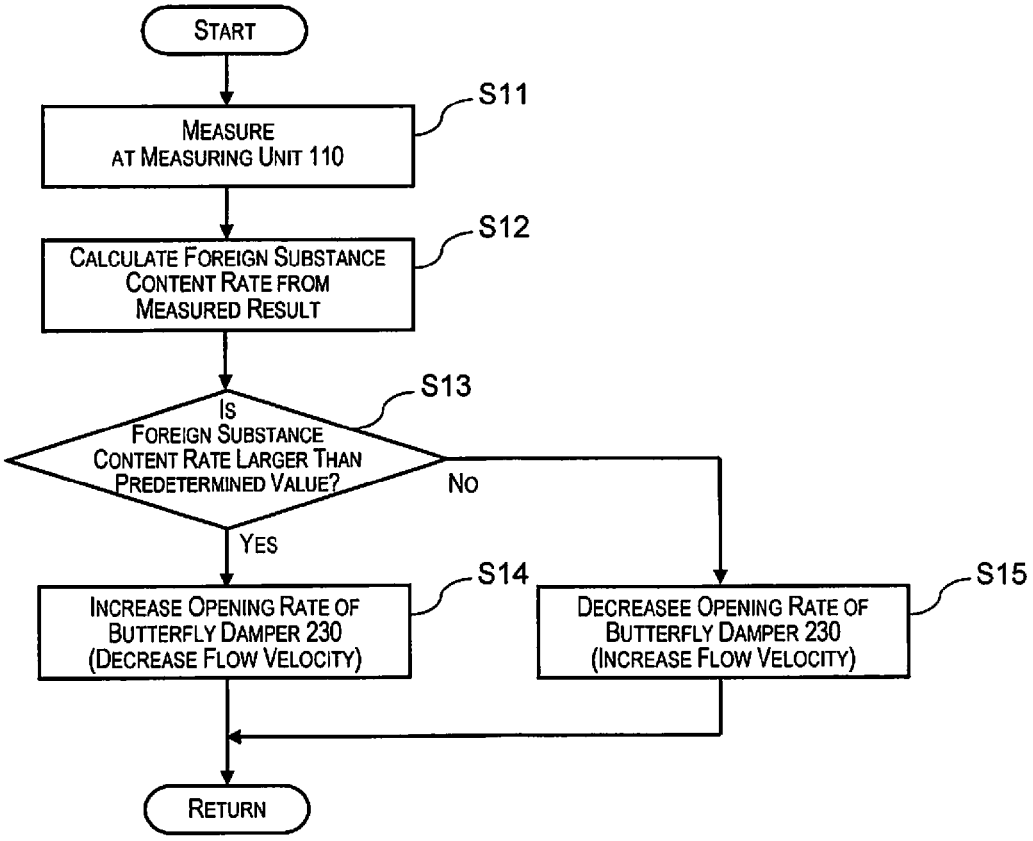
FIG. 8 is a flow chart showing the control according to the second embodiment.
FIG. 9 shows data showing the collection rates of foreign substances and defibrated fibers of the sheet manufacturing apparatus according to the second embodiment.

FIG. 9 shows the data of the collection rate of foreign substances and defibrated fibers of the sheet manufacturing apparatus 1*a* of this embodiment. The data shows the collection rates of the defibrated fibers and the foreign substances when the defibrated fibers passed at the butterfly damper opening rate of 50% and 100% in the case in which the foreign substance content rate in the defibrated material was 42 wt % and the foreign substance content rate in the defibrated material was 15 wt %. In this embodiment, when the collection rate of the foreign substances and that of the defibrated fibers were 90% or higher, respectively, it was judged as PASSED, and when the collection rates were less than 90%, it was judged as FAILED (showed by shading).

As shown in FIG. 9, in the case in which the foreign substance content rate of the defibrated material was 42 wt % (in the case in which the foreign substance content rate was high), the collection rate (%) of foreign substances was higher (90%) in the case in which the opening rate of the butterfly damper was 100% (full-open) than in the case in which the opening rate (%) of the butterfly damper was 50% (half-open), and it was judged as PASSED. Further, in cases in which the opening rates of the butterfly damper were 50% and 100%, both collection rates of defibrated fibers were 90% or higher, and both of them were judged as PASSED. This is because, when the opening rate of the butterfly damper 230 was increased, the flow velocity of defibrated fibers passing through the cyclone 40 deteriorated, which in turn improved the deinking efficiency.

On the other hand, in the case in which the foreign substance content rate of the defibrated material was 15 wt % (in the case in which the foreign substance content rate was low), the collection rate (%) of defibrated fibers was higher, 90% or higher in the case in which the opening rate of the butterfly damper was 50% (half-open) than in the case in which the opening rate of the butterfly damper was 100% (full-open) and it was judged as PASSED. Further, in cases in which the opening rates of the butterfly damper were 50% and 100%, both collection rates of foreign substances were 90% or higher, and both of them were judged as PASSED. This is because, when the opening rate of the butterfly damper 230 was decreased, the flow velocity of defibrated fibers passing through the cyclone 40 increased, thereby increasing the centrifugal force applied to defibrated fibers and foreign substances in the cyclone 40, which in turn enhanced the movement of the defibrated fibers and foreign substances to the lower outlet 46 of the cyclone 40 and therefore a certain amount of foreign substances was removed and the collection efficiency of defibrated fibers was improved.

According to the aforementioned embodiment, the following effects can be obtained.

(1) Depending on the content rate of foreign substances of the stock material (defibration object), for example, in the case in which the content rate of foreign substances contained in the stock material is larger than a predetermined value, the opening rate of the butterfly damper 230 is increased. With this, the flow velocity in the cyclone 40 decreases, which enables collection of the defibrated fibers while collecting foreign substances. Further, in the case in which the content rate of foreign substances contained in the stock material is smaller than a predetermined value, the opening rate of the butterfly damper 230 is decreased. With this, the flow velocity in the cyclone 40 increases, which enables collection of defibrated fibers while collecting foreign substances. As mentioned above, by changing or adjusting the flow velocity of the defibrated material in the cyclone 40 depending on the foreign substance content rate of the stock material, the collection of foreign substances and the collection of defibrated fibers can be balanced, the production efficiency can be enhanced, and further a high-quality sheet can be produced.

It should be noted that the present invention is not limited to the aforementioned embodiments, and various changes and/or improvements can be made on the aforementioned embodiment. Hereinafter, modified embodiments will be described.

Modified Embodiment

In the aforementioned embodiment, the flow velocity of the defibrated material in the cyclone 40 is controlled by selecting the first piping 36 or the second piping 37 depending on the foreign substance content rate of the stock material. On the other hand, in the second embodiment, the flow velocity of the defibrated material in the cyclone 40 is controlled by changing the opening rate of the butterfly damper 230 depending on the foreign substance content rate of the stock material, but not limited to these structures.

Figure 10:
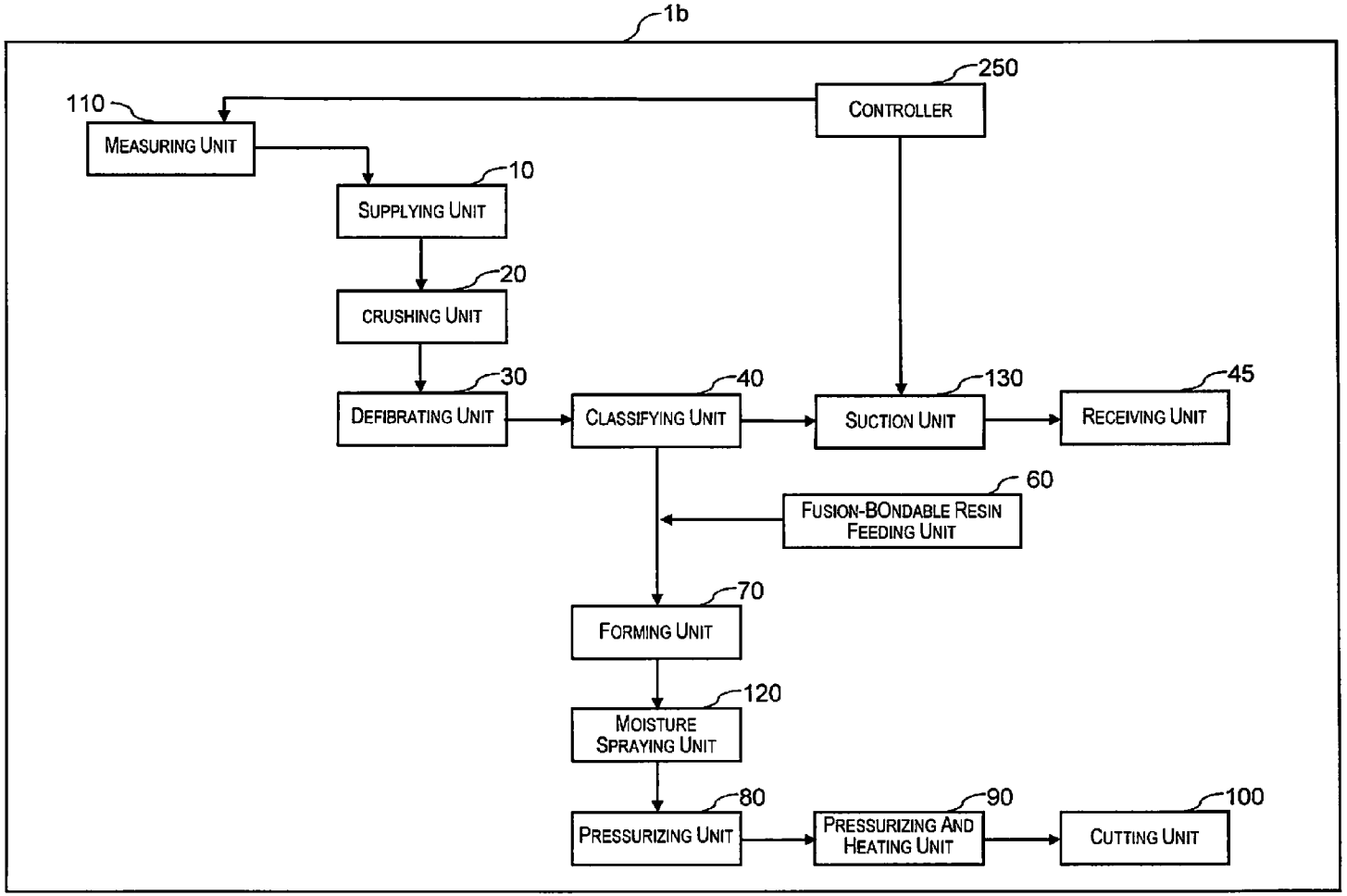
FIG. 10 is a schematic view showing a structure of a sheet manufacturing apparatus according to a modified example.
Figure 11:
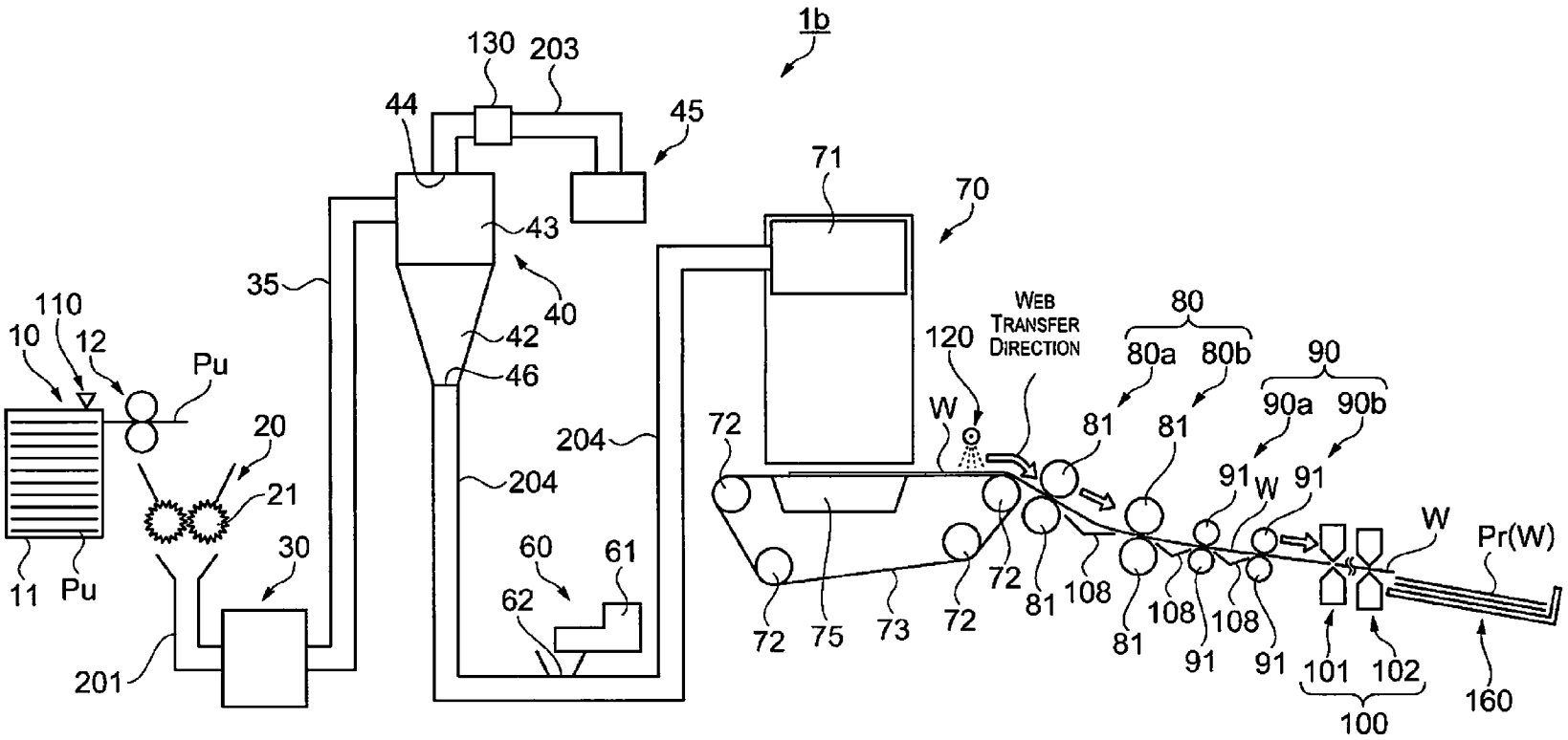
FIG. 11 is another schematic view showing the structure of the sheet manufacturing apparatus according to the modified example.

FIGS. 10 and 11 are schematic views showing the structure of a sheet manufacturing apparatus according to a modified example. As shown in FIGS. 10 and 11, a suction portion 130 is provided at the piping 203 between the cyclone 40 and the receiving unit 45 of the sheet manufacturing apparatus 1*b*. As to the same structure as in the first embodiment, the explanation will be omitted by allotting the same symbol.

Figure 12:
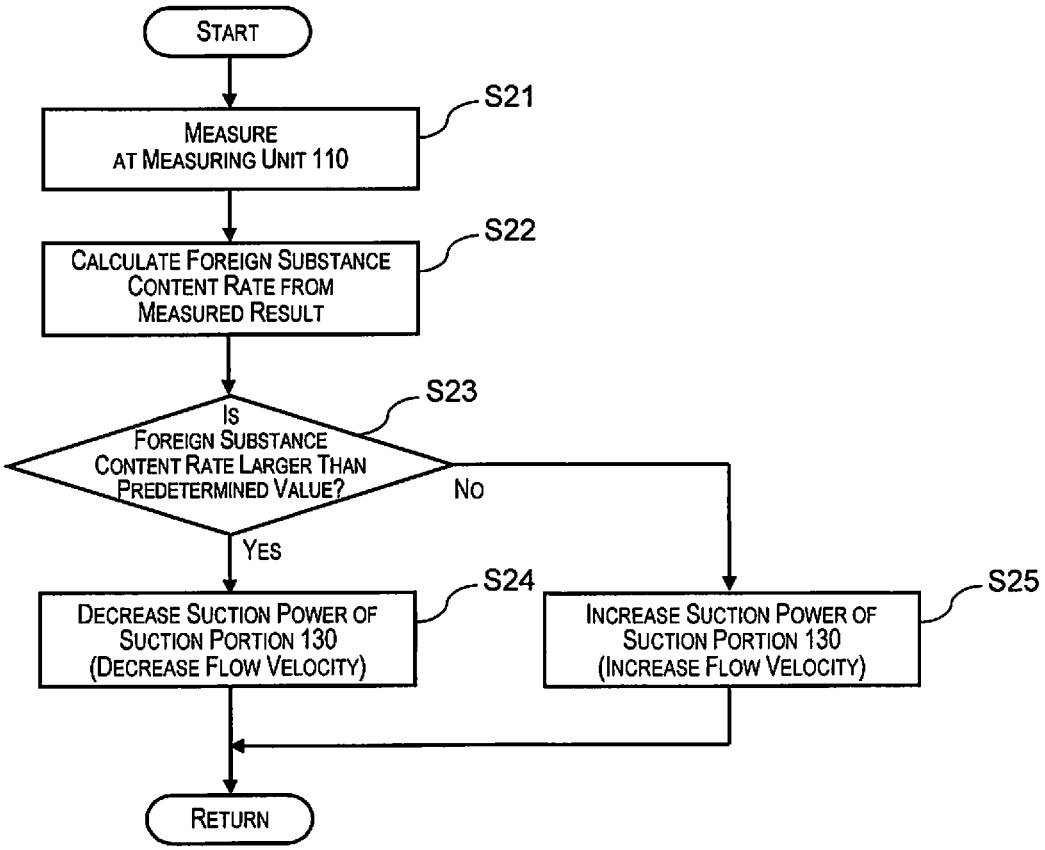
FIG. 12 is a flow chart showing the control according to the modified example.

A control method of the sheet manufacturing apparatus 1*b* will be explained based on the flow chart of FIG. 12. A controller 250 drives the measuring unit 110 to make the measuring unit 110 measure the thickness and the air permeability of the stock material as a defibration object to be fed from the supplying unit 10 to the crushing unit 20 (Step S21).

Then, based on the measured thickness and air permeability of the stock material, the content rate of foreign substances (foreign substance content rate) contained in the stock material is calculated from the data table (Step S22).

Then, depending on the calculated foreign substance content rate, the suction power of the suction portion 130 is controlled.

The controller 250 judges whether or not the air permeability with respect to the thickness of the stock material is larger than a predetermined value, that is, whether or not the foreign substance content rate of the stock material is larger than a predetermined value (Step S23), and controls the suction power of the suction portion 130.

If the foreign substance content rate of the stock material is larger than the predetermined value (Step S23: YES), the controller 250 decreases the suction power of the suction portion 130 (Step S24). With this, the flow velocity of the defibrated material can be reduced (weakened). Thus, the centrifugal force applied to the defibrated fibers and the foreign substances in the cyclone 40 is reduced, and therefore the foreign substances smaller in size and lower in density than fibers can be easily discharged from the upper exhaust port 44 of the cyclone 40, resulting in an increased collection efficiency of the foreign substances.

On the other hand, if the foreign substance content rate of the stock material is smaller than the predetermined value (Step S23: NO), the controller 250 increases the suction power of the suction portion 130 (Step S25). With this, the flow velocity of the defibrated material in the cyclone 40 pieces increases. Thus, the centrifugal force applied to the defibrated fibers and the foreign substances in the cyclone 40 increases, and therefore the movement of the foreign substances to the upper exhaust port 44 of the cyclone 40 is controlled (deinking processing capacity). The defibrated fibers and the foreign substances can be easily moved to the lower outlet 46 of the cyclone 40, resulting in an increased collection rate of the defibrated fibers.

In each of the aforementioned embodiments and modified example, the control is changed depending on two cases, i.e., whether nor not the foreign substance content rate is larger than the predetermined value, but not limited to it. The control can be changed depending on two cases, i.e., whether or not the air permeability is large or small. The case in which the foreign substance content rate or the air permeability of the stock material is larger than the predetermined value corresponds to "the case in which the air permeability is in the first case," and the case in which the foreign substance content rate or the air permeability of the stock material is smaller than the predetermined value corresponds to "the case in which the air permeability is smaller than in the first case." The control can be performed depending on three or more cases of the air permeability or the foreign substance content rate.

The sheet according to the aforementioned embodiment mainly denotes a member including fibers such as used paper or a pure pulp and formed into a sheet shape, but not limited to it, and can be a board shape, a web shape, or a shape having irregularities. Further, as the stock material, it can be a plant fiber of cellulose, etc., a chemical fiber of PET (polyethylene terephthalate), polyester, etc., or an animal fiber such as wool, silk, etc. The sheet in this application can be divided into paper and nonwoven fabric. Paper can be in a thin sheet like mariner, etc., and includes recording paper used for writing or printing, wallpaper, wrapping paper, colored paper, Kent paper, etc. Nonwoven fabric can be thicker than paper or lower in strength, and includes a nonwoven fabric, a fiber board, tissue paper, kitchen paper, a cleaner, a filter, a liquid absorbing material, a sound absorber, a cushioning material, etc.

As indicated by the numerals of the collection rate in FIG. 5 and FIG. 9, it is not configured to collect all of the foreign substances or collect all of the defibrated fibers. This is because there is a case in which foreign substances are adhered to defibrated fibers and cannot be detached therefrom or a case in which shorter fibers among the defibrated fibers are collected together with foreign substances. For this reason, even if it is said such that "separate and remove the foreign substances from defibrated material" or "separate and classify into fibers and foreign substances," the case in which they are not completely separated, classified, or removed is also included.

In the aforementioned embodiment, the wordings of "uniform," "circular," etc., include errors, error accumulations, etc., and do not require to be a complete uniform or true circle.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A sheet manufacturing apparatus comprising:

a measuring unit configured to measure thickness and air permeability of a defibration object containing fibers;

a defibrating unit configured to dry-defibrate the defibration object, after the thickness and the air permeability have been measured by the measuring unit, to obtain defibrated material; and a classifying unit configured to separate and remove, by airflow classification, foreign substances other than the fibers from the defibrated material obtained at the defibrating unit.

2. The sheet manufacturing apparatus according to claim 1, further comprises a control unit configured to control a flow velocity of the defibrated material passing through the classifying unit depending on a measured result of the measuring unit.

3. The sheet manufacturing apparatus according to claim 2, wherein the flow velocity of the defibrated material when the air permeability with respect to the thickness of the defibration object is a first case is lowered than the flow velocity of the defibrated material when the air permeability with respect to the thickness of the defibration object is smaller than the first case.

4. The sheet manufacturing apparatus according to claim 3, further comprising a first flow passage and a second flow passage that are different in pipe diameter and connect the defibrating unit and the classifying unit, wherein a pipe diameter of the first flow passage for passing the defibrated material when the air permeability with respect to the thickness of the defibration object is the first case is larger than a pipe diameter of the second flow passage for passing the defibrated material when the air permeability with respect to the thickness of the defibration object is smaller than the first case.

5. The sheet manufacturing apparatus according to claim 2, further comprising a suction portion connected to the classifying unit to suck the foreign substances, wherein a suction power of the suction portion when the air permeability with respect to the defibration object is the first case is weaker than a suction power of the suction unit when the air permeability with respect to the thickness of the object defibration is smaller than the first case.

* * * * *